US011686188B1

(12) United States Patent
Fournier

(10) Patent No.: US 11,686,188 B1
(45) **Date of Patent: *Jun. 27, 2023**

(54) SYSTEMS AND METHODS FOR CONDITIONING A GAS

(71) Applicant: ProFrac Services, LLC, Willow Park, TX (US)

(72) Inventor: Christopher A. Fournier, Fort Worth, TX (US)

(73) Assignee: PROFRAC SERVICES, LLC, Willow Park, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/049,320

(22) Filed: Oct. 25, 2022

Related U.S. Application Data

(62) Division of application No. 17/873,688, filed on Jul. 26, 2022, now Pat. No. 11,549,351.

(51) Int. Cl.
*E21B 43/34* (2006.01)
*E21B 43/26* (2006.01)
*E21B 34/02* (2006.01)

(52) U.S. Cl.
CPC ..... *E21B 43/35* (2020.05); *E21B 34/02* (2013.01); *E21B 43/2607* (2020.05); *E21B 2200/04* (2020.05)

(58) Field of Classification Search
CPC ..... E21B 43/35; E21B 43/2607; E21B 34/02; E21B 2200/04
See application file for complete search history.

(56) References Cited

U.S. PATENT DOCUMENTS

| | | | | |
|---|---|---|---|---|
| 4,031,407 | A | 6/1977 | Reed | |
| 9,187,996 | B1 * | 11/2015 | Nevison | E21B 43/34 |
| 11,359,474 | B1 * | 6/2022 | Uhlmer | E21B 43/2607 |
| 11,459,860 | B2 | 10/2022 | Archa et al. | |
| 11,460,368 | B2 | 10/2022 | Yeung et al. | |
| 11,549,351 | B1 * | 1/2023 | Fournier | E21B 43/2607 |
| 2020/0181998 | A1 | 6/2020 | Ye et al. | |
| 2021/0156240 | A1 * | 5/2021 | Cicci | F04B 15/02 |
| 2021/0348476 | A1 * | 11/2021 | Yeung | E21B 47/12 |

* cited by examiner

*Primary Examiner* — Yong-Suk (Philip) Ro
(74) *Attorney, Agent, or Firm* — MH2 Technology Law Group LLP

(57) ABSTRACT

A system for conditioning a gas includes an inlet configured to receive the gas from a gas source. The system also includes a strainer downstream from the inlet. The strainer is configured to remove debris from the gas. The system also includes a first flowpath downstream from the strainer. The first flowpath includes a first pressure regulator that is configured to regulate a pressure of the gas by a first amount. The system also includes a second flowpath downstream from the strainer. The first and second flowpaths are parallel. The second flowpath includes a second pressure regulator that is configured to regulate the pressure of the gas by a second amount. The system also includes one or more flowpath valves downstream from the strainer and upstream from the first pressure regulator, the second pressure regulator, or both.

20 Claims, 3 Drawing Sheets

SYSTEMS AND METHODS FOR CONDITIONING A GAS

CROSS-REFERENCE TO RELATED APPLICATIONS

This patent application is a divisional of U.S. patent application Ser. No. 17/873,688, filed on Jul. 26, 2022, the entirety of which is incorporated herein by reference.

BACKGROUND

Hydraulic fracturing (also called fracking) is a well-stimulation technique involving the fracturing of bedrock formations by a pressurized liquid. The process involves the high-pressure injection of a fracking fluid into a wellbore to create fractures (e.g., cracks) in the deep-rock formations. The fracking fluid may be or include water containing proppants (e.g., either sand or aluminum oxide) suspended with the aid of thickening agents. When the hydraulic pressure is removed from the wellbore, the proppants hold the fractures open to allow natural gas, petroleum, and/or brine to flow through the fractures, up the wellbore, and to the surface.

The fracking fluid is injected into the wellbore using a frac pump located at the surface. The frac pump is powered by a frac engine. The frac engine uses gas (e.g., natural gas) as its fuel. The gas available at a wellsite may be unconditioned. For example, the gas may have debris therein that may clog or damage the frac engine. In another example, the gas may not be within the operating pressure range of the frac engine. Therefore, a gas conditioning system may be used to condition the gas before the gas is fed to the frac engine. What is needed is an improved system and method for conditioning the gas.

SUMMARY

A system for conditioning a gas is disclosed. The system includes an inlet configured to receive the gas from a gas source. The system also includes a strainer downstream from the inlet. The strainer is configured to remove debris from the gas. The system also includes a first flowpath downstream from the strainer. The first flowpath includes a first pressure regulator that is configured to regulate a pressure of the gas by a first amount. The system also includes a second flowpath downstream from the strainer. The first and second flowpaths are parallel. The second flowpath includes a second pressure regulator that is configured to regulate the pressure of the gas by a second amount. The system also includes one or more flowpath valves downstream from the strainer and upstream from the first pressure regulator, the second pressure regulator, or both. The one or more flowpath valves are configured to actuate between a first position and a second position. The one or more flowpath valves are configured to direct the gas to flow through the first flowpath and prevent the gas from flowing through the second flowpath while in the first position. The one or more flowpath valves are configured to direct the gas to flow through the second flowpath and prevent the gas from flowing through the first flowpath while in the second position. The system also includes an outlet downstream from the first and second flowpaths. The outlet is configured to discharge the gas.

In another embodiment, the system includes an inlet configured to receive the natural gas from a gas source. The system also includes a strainer downstream from the inlet. The strainer is configured to remove debris from the natural gas. The system also includes a first flowpath downstream from the strainer. The first flowpath includes a first pressure regulator that is configured to regulate a pressure of the natural gas by a first amount that is between about 1 psi and about 100 psi. The system also includes a second flowpath downstream from the strainer. The first and second flowpaths are parallel. The second flowpath includes a second pressure regulator and a third pressure regulator. The second pressure regulator is configured to regulate the pressure of the natural gas by a second amount that is between about 100 psi and about 1000 psi. The system also includes one or more flowpath valves downstream from the strainer and upstream from the first pressure regulator, the second pressure regulator, the third pressure regulator, or a combination thereof. The one or more flowpath valves are configured to actuate between a first position and a second position. The one or more flowpath valves are configured to direct the natural gas to flow through the first flowpath and prevent the natural gas from flowing through the second flowpath while in the first position. The one or more flowpath valves are configured to direct the natural gas to flow through the second flowpath and prevent the natural gas from flowing through the first flowpath while in the second position. The system also includes an outlet downstream from the first and second flowpaths. The outlet is configured to discharge the natural gas.

In another embodiment, the system may be mounted on a trailer and configured to condition a natural gas at a wellsite. The system includes an inlet configured to receive the natural gas from a gas source. The gas source includes a pipeline, a wellbore, or a vehicle. The natural gas includes raw natural gas, compressed natural gas, or liquid natural gas. The inlet is configured to receive the natural gas at any pressure ranging from about 100 psi to about 1440 psi. The system also includes an actuated ball valve connected to and downstream from the inlet. The actuated ball valve is configured to actuate between an open position and a closed position. The system also includes a Y-strainer connected to and downstream from the actuated ball valve. The Y-strainer is configured to remove debris from the natural gas. The system also includes a first flowpath connected to and downstream from the Y-strainer. The first flowpath includes a first pressure regulator that is configured to regulate the pressure of the natural gas by a first amount that is between about 1 psi and about 100 psi while reducing a temperature of the natural gas by less than a first predetermined temperature amount. The system also includes a second flowpath connected to and downstream from the Y-strainer. The second flowpath is parallel with the first flowpath. The second flowpath includes a second pressure regulator and a third pressure regulator. The second pressure regulator includes a working pressure regulator that is configured to regulate the pressure of the natural gas by a second amount that is between about 100 psi and about 1000 psi while reducing the temperature of the natural gas by less than a second predetermined temperature amount. The third pressure regulator is connected to and upstream from the second pressure regulator. The third pressure regulator includes a monitor pressure regulator that is configured to monitor the pressure of the natural gas downstream from the second pressure regulator and to regulate the pressure of the natural gas in response to the monitored pressure being greater than a predetermined pressure threshold. The system also includes one or more flowpath valves downstream from the Y-strainer and upstream from the first pressure regulator, the second pressure regulator, the third pressure regulator, or a combination thereof. The one or more flowpath valves are configured to actuate between a first position and a second position. The one or more flowpath valves are configured to direct the natural gas to flow through the first flowpath and prevent the natural gas from flowing through the second flowpath while in the first position. The one or more flowpath valves are configured to direct the natural gas to flow through the second flowpath and prevent the natural gas from flowing through the first flowpath while in the second position. The system also includes a gas scrubber connected to and downstream from the first and second flowpaths. The gas scrubber is configured to remove liquid from the natural gas. The system also includes a gas meter connected to and downstream from the gas scrubber. The gas meter is configured to measure the pressure of the natural gas, a flow rate of the natural gas, or both. The system also includes a check valve connected to and downstream from the gas meter. The check valve is configured to permit the natural gas to flow in a downstream direction and prevent the natural gas from flowing in an upstream direction. The system also includes a British thermal unit (BTU) measurement pipeline tap connected to and downstream from the check valve. The BTU measurement pipeline tap is configured to measure the BTUs of the natural gas. The system also includes an outlet connected to and downstream from the BTU meter. The outlet is configured to connect to a hydraulic fracturing engine, which uses the natural gas as a fuel. The system does not include an overpressure relief valve that is configured to vent the natural gas to the atmosphere.

A method for conditioning a gas is also disclosed. The method includes connecting an inlet of a system to a gas source. The method also includes connecting an outlet of the system to equipment. The method also includes actuating one or more flowpath valves of the system into a first position to direct gas from the gas source to flow through a first flowpath of the system and not a second flowpath of the system. The first and second flowpaths are parallel. The first flowpath includes a first pressure regulator that is configured to regulate a pressure of the gas by a first amount. The second flowpath includes a second pressure regulator that is configured to regulate the pressure of the gas by a second amount that is different than the first amount. The method also includes conditioning the gas with the system. Conditioning the gas includes receiving the gas from the gas source, removing debris from the gas, regulating the pressure of the gas, and discharging the gas to the equipment which uses the gas as a fuel.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the embodiments described herein. However, it will be apparent to one of ordinary skill in the art that other embodiments may be practiced without these specific details. In other instances, well-known methods, procedures, components, circuits, and networks have not been described in detail so as not to unnecessarily obscure aspects of the embodiments.

Figure 1:
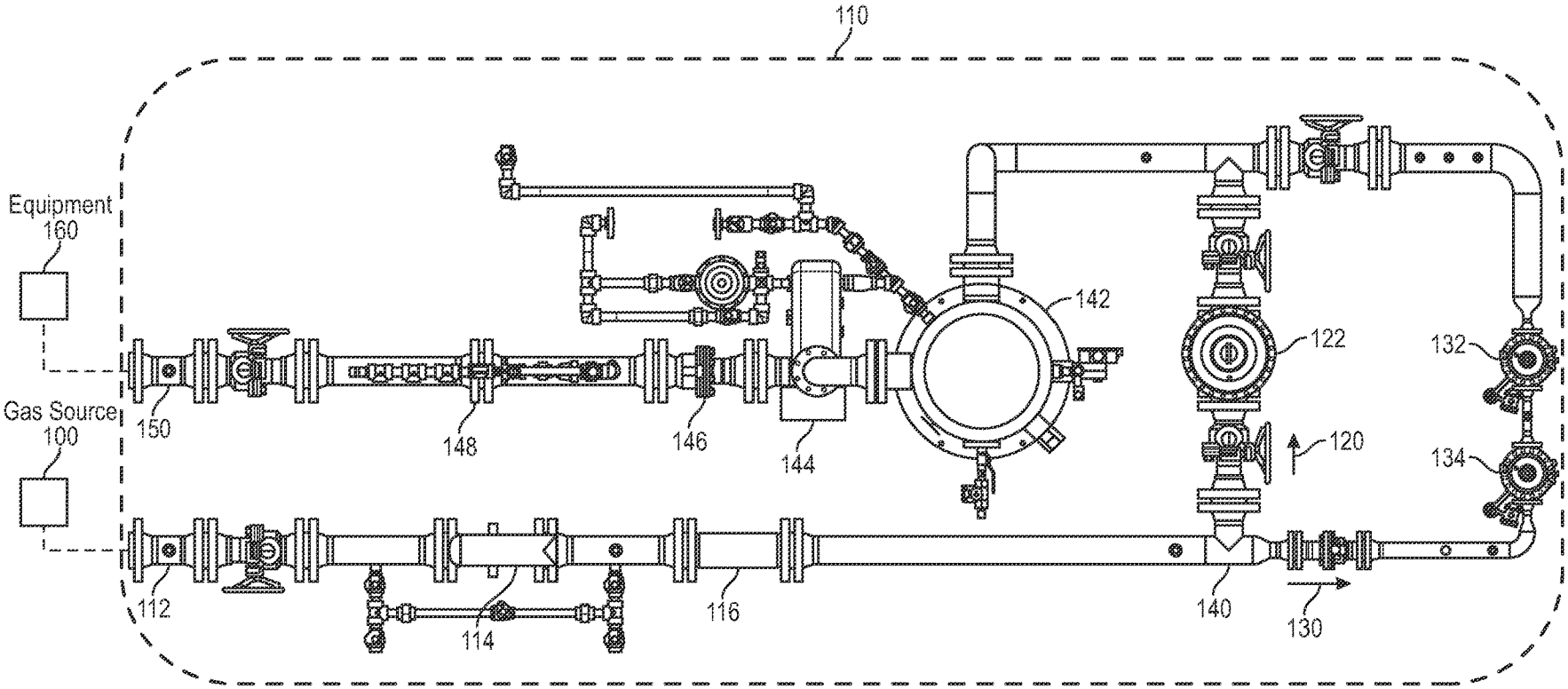
FIG. 1 illustrates a plan view of a system for conditioning a gas, according to an embodiment.

FIG. 1 illustrates a plan view of a system 110 for conditioning a gas, according to an embodiment. In the following description, the system 110 is used at a wellsite; however, the system 110 may also or instead be used at other locations and/or for other purposes. As described in greater detail below, the system 110 may be configured to receive a gas from a gas source 100, condition the gas, and provide the gas to equipment 160 where it may be used as fuel.

The gas source 100 may be or include a pipeline (e.g., a mid-stream pipeline), a wellbore, a vehicle (e.g., a truck), or the like. The gas supplied by the gas source 100 may be or include natural gas. For example, the gas may be or include raw field gas (e.g., from the wellbore), compressed natural gas (CNG), liquid natural gas (LNG), or a combination thereof.

As used herein, "conditioning the gas" refers to cleaning the gas (e.g., removing debris therefrom) and/or regulating one or more properties of the gas. As used herein, "regulating" refers to maintaining and/or varying (e.g., increasing and/or decreasing). The properties may be or include the pressure, the flow rate, the temperature, the composition, the British thermal units (BTUs), or a combination thereof. The gas may be conditioned based at least partially upon the properties of the gas upstream from the system 110 (e.g., at the gas source 100) and/or the desired properties of the gas downstream from the system 110 (e.g., the operating ranges of the equipment 160). In one example, conditioning the gas may help to prevent the equipment 160 from being subjected to overpressure (i.e., pressure that is above the operating range). The equipment 160 may be or include an engine (e.g., a frac engine), a turbine, or the like that is configured to use the conditioned gas as fuel.

The system 110 may include an inlet 112 that is configured to receive the gas from the gas source 100. The gas received at the inlet 112 may have a pressure from about 100 psi (689 kPa) to about 1440 psi (9928 kPa), a flow rate from about 0 million standard cubic feet per day (MMSCFD) to about 15 MMSCFD, and/or a temperature from about 0° F. (−17.8° C.) to about 120° F. (48.9° C.). In contrast, conventional conditioning systems are not configured to receive and condition gas over such a large pressure range because the conventional conditioning system requires the pressure regulation equipment be sized and installed for a specific (e.g., smaller) operating range.

The system 110 may also include a valve 114 that is connected to and downstream from the inlet 112. The valve 114 may be or include an actuated ball valve. The valve 114 may be configured to actuate between a first (e.g., open) position and a second (e.g., closed) position. In the open position, the gas is permitted to flow downstream through the valve 114 (to the right in FIG. 1), and in the closed position, the gas is prevented from flowing downstream through the valve 114. The valve 114 may be actuated into the closed position in response to the pressure of the gas measured downstream from the valve 114 being greater than and/or less than a predetermined value. The valve 114 may also or instead be actuated into the closed position in response to the BTU measurement of the gas measured downstream from the valve 114 being greater than and/or less than a predetermined value. The valve 114 may also or instead be actuated into the closed position in response to a liquid level in a scrubber (introduced below) being greater than a predetermined level to prevent liquid from being introduced into the equipment 160.

The system 110 may also include a strainer 116 that is connected to and downstream from the valve 114. The strainer 116 may be or include a Y-strainer. The strainer 116 may be configured to remove debris (e.g., particles) from the gas, which may prevent damage to downstream pressure regulators and/or the equipment 160.

Downstream from the strainer 116, the system 110 may include a fork that defines first and second flowpaths 120, 130. The flowpaths 120, 130 may be in parallel with one another. The first flowpath 120 may be referred to as a low pressure regulation flowpath that is configured to regulate the pressure of the gas by a first (e.g., low) amount. The second flowpath 130 may be referred to as a high pressure regulation flowpath that is configured to regulate the pressure of the gas by a second (e.g., high) amount. The second amount is greater than the first amount. In an example, the first amount may be between about 1 psi (6.9 kPa) and about 100 psi (689 kPa), and the second amount may be between about 100 psi (689 kPa) and about 1,000 psi (6895 kPa).

The amount that the gas is regulated, and thus the selection of the first flowpath 120 or the second flowpath 130, may be based at least partially upon (or in response to) the properties of the gas upstream from the system 110 (e.g., at the gas source 100) and/or the desired properties of the gas downstream from the system 110 (e.g., the operating ranges of the equipment 160). In one embodiment, the gas may only flow through one of the flowpaths 120, 130 at a time. In one example, the gas may flow through the first flowpath 120 if the gas requires regulation by the first amount, and the second flowpath 130 may be closed. In another example, the gas may flow through the second flowpath 130 if the gas requires regulation by the second amount, and the first flowpath 120 may be closed. In another embodiment, the gas may flow through both flowpaths 120, 130 simultaneously. For example, a first portion of the gas may flow through the first flowpath 120, a second portion of the gas may flow through the second flowpath 130, and the first and second portions may re-combine downstream from the flowpaths 120, 130.

The first flowpath 120 may include a first pressure regulator 122. The first pressure regulator 122 regulates one or more of the properties of the gas. For example, the first pressure regulator 122 may reduce the pressure of the gas by the first amount while reducing the temperature of the gas by less than a first predetermined temperature amount (e.g., 7° F. or 3.9° C.). In another example, the first pressure regulator 122 may reduce the pressure of the gas by the first amount while reducing the BTUs of the gas by less than a first predetermined BTU amount.

The second flowpath 130 may include a second pressure regulator (also referred to as a working pressure regulator) 132. The pressure regulator 132 regulates one or more of the properties of the gas. For example, the second pressure regulator 132 may reduce the pressure of the gas by the second amount while reducing the temperature of the gas by less than a second predetermined temperature amount. The second predetermined temperature amount may be from about 7° F. (3.9° C.) to about 70° F. (39° C.). In another example, the second pressure regulator 132 may reduce the pressure of the gas by the second amount while reducing the BTUs of the gas by less than a second predetermined BTU amount. The second predetermined BTU amount may be greater than the first predetermined BTU amount.

In one embodiment, the second flowpath 130 may also include a third pressure regulator (also referred to as a monitoring pressure regulator) 134. The third pressure regulator 134 may be positioned upstream from the second pressure regulator 132. The third pressure regulator 134 may be configured to monitor the pressure of the gas downstream from the second pressure regulator 132 and to provide overpressure protection in the event that the second pressure regulator 132 fails to regulate the pressure by the second amount. Thus, the third pressure regulator 134 may also be configured reduce the pressure of the gas by the second amount (or a third amount) while reducing the temperature and/or BTUs of the gas by less than the second (or a third) predetermined amount.

The system 110 may also include one or more flowpath valves (one is shown: 140) that may be positioned upstream from the first pressure regulator 122, the second pressure regulator 132, the third pressure regulator 134, or a combination thereof. In the embodiment shown, a single flowpath valve 140 may be located proximate to the fork. The flowpath valve 140 may have a first position that directs the gas into the first flowpath 120 while preventing the gas from flowing into the second flowpath 130. The flowpath valve 140 may also have a second position that directs the gas into the second flowpath 130 while preventing the gas from flowing into the first flowpath 120. The flowpath valve 140 may optionally have a third position that prevents the gas from flowing into the first flowpath 120 or the second flowpath 130. The flowpath valve 140 may optionally have a fourth position that directs a first portion of the gas to flow into the first flowpath 120 and a second portion of the gas to flow into the second flowpath 130.

In another embodiment (not shown), the one or more flowpath valves 140 may include a first valve that is positioned within the first flowpath 120 and a second valve that is positioned within the second flowpath 130. The first valve may be upstream or part of the first pressure regulator 122, and the second valve may be upstream or part of the second pressure regulator 132 or the third pressure regulator 134. In this embodiment, the first valve may be open and the second valve may be closed to direct the gas into the first flowpath 120. Similarly, the first valve may be closed, and the second valve may be opened to direct the gas into the second flowpath 130.

The system 110 may also include a scrubber 142 that is connected to and downstream from the first and second flowpaths 120, 130. The scrubber 142 may be or include a gas scrubber that is configured to remove liquid from the gas.

The system 110 may also include a gas meter 144 that is connected to and downstream from the scrubber 142. The gas meter 144 may be configured to measure one or more of the properties (e.g., the pressure and/or flow rate) of the gas as the gas flows therethrough.

The system 110 may also include a check valve 146 that is connected to and downstream from the gas meter 144. The check valve 146 may be configured to permit the gas to flow downstream therethrough and to prevent the gas (or any other fluid) from flowing upstream therethrough.

The system 110 may also include one or more British thermal unit (BTU) pipeline taps 148 that are connected to and downstream from the check valve 146. The taps 148 may be configured to measure the BTUs of the gas. In addition, the taps 148 may allow the system 110 to omit a gas chromatograph, which may be present in conventional gas conditioning systems. More particularly, the taps 148 may allow for the installation of an inline optical analyzer for determining the natural gas composition and/or BTUs. This may reduce the sample time as compared to a conventional gas chromatograph, and the inline design results in zero emissions. With a conventional gas chromatograph installation, the gas is sampled from the pipeline in predetermined intervals, and the sampled gas is then typically vented to the atmosphere.

The system 110 may also include an outlet 150 that is connected to and downstream from the taps 148. The outlet 150 may be configured to discharge the (now conditioned) gas. For example, the outlet 150 may be configured to connect to the equipment 160 and to discharge the gas to the equipment 160 for use as fuel.

Conventional systems may include only a single flowpath and a single pressure regulator. As a result, if the operating ranges of the equipment 160 change and/or the conventional system is connected to different equipment 160 with different operating ranges, the conventional system may need to be shut down to modify or replace the pressure regulator. This takes time, which results in lost profits. In contrast, the system 110 described herein may switch flowpaths 120, 130, which may happen almost instantaneously (e.g., less than 1 minute) by actuating the one or more flowpath valves 140, which may reduce both the downtime and lost profits.

In addition, conventional systems may include a relief valve in the main flowpath that is configured to vent the gas to the atmosphere if/when the system 110 fails to condition the gas to meet the operating ranges of the equipment 160. The relief valve is prone to leaking. In addition, the vented gas may represent pollution in the atmosphere. The multiple flowpaths 120, 130 and/or the multiple pressure regulators 122, 132, 134 may allow the system 110 described herein to omit such a relief valve in the main flowpath (and avoid polluting the atmosphere) because the pressure regulators 132 and 134 may be configured in a worker/monitor configuration. This provides for overpressure protection in the event of a failure of the primary working regulator 132. In addition, the valve 114 may monitor and/or receive the pressure at the outlet 150 of system 110, and the valve 114 may close in the event that the pressure exceeds the predetermined acceptable limit for that job. The pressure at the outlet 150 may be measured pneumatically and/or with pressure transmitters, which may provide redundancy.

Figure 2:
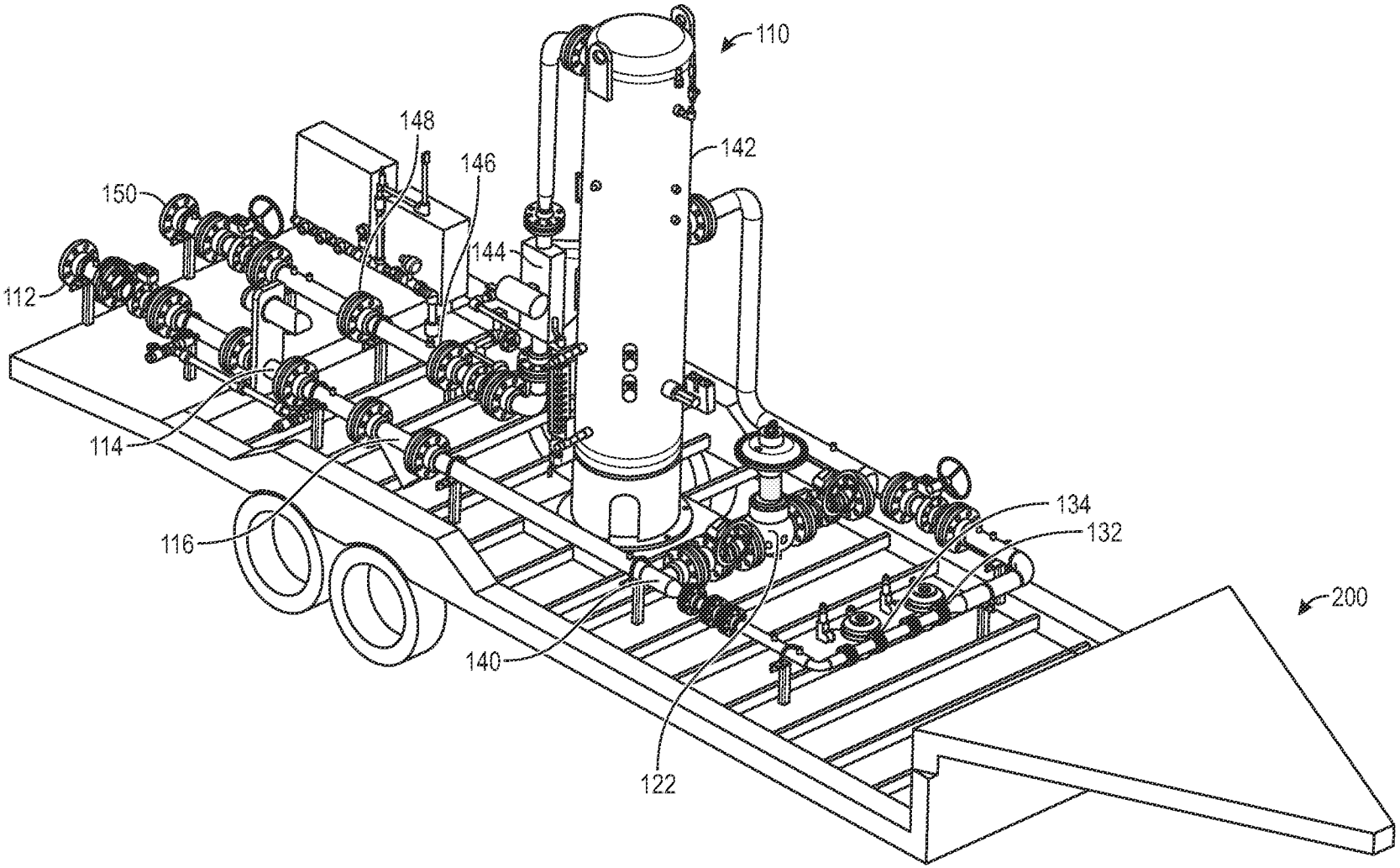
FIG. 2 illustrates a perspective view of the system mounted on a mobile unit, according to an embodiment.

FIG. 2 illustrates a perspective view of the system 110 mounted on a mobile unit 200, according to an embodiment. The mobile unit 200 may be or include a trailer with a plurality of wheels that may be towed to any desired location by a vehicle (e.g., a truck). This may allow the system 110 to be used to fracture different wellbores at a single wellsite, or to service a plurality of different wellsites.

Figure 3:
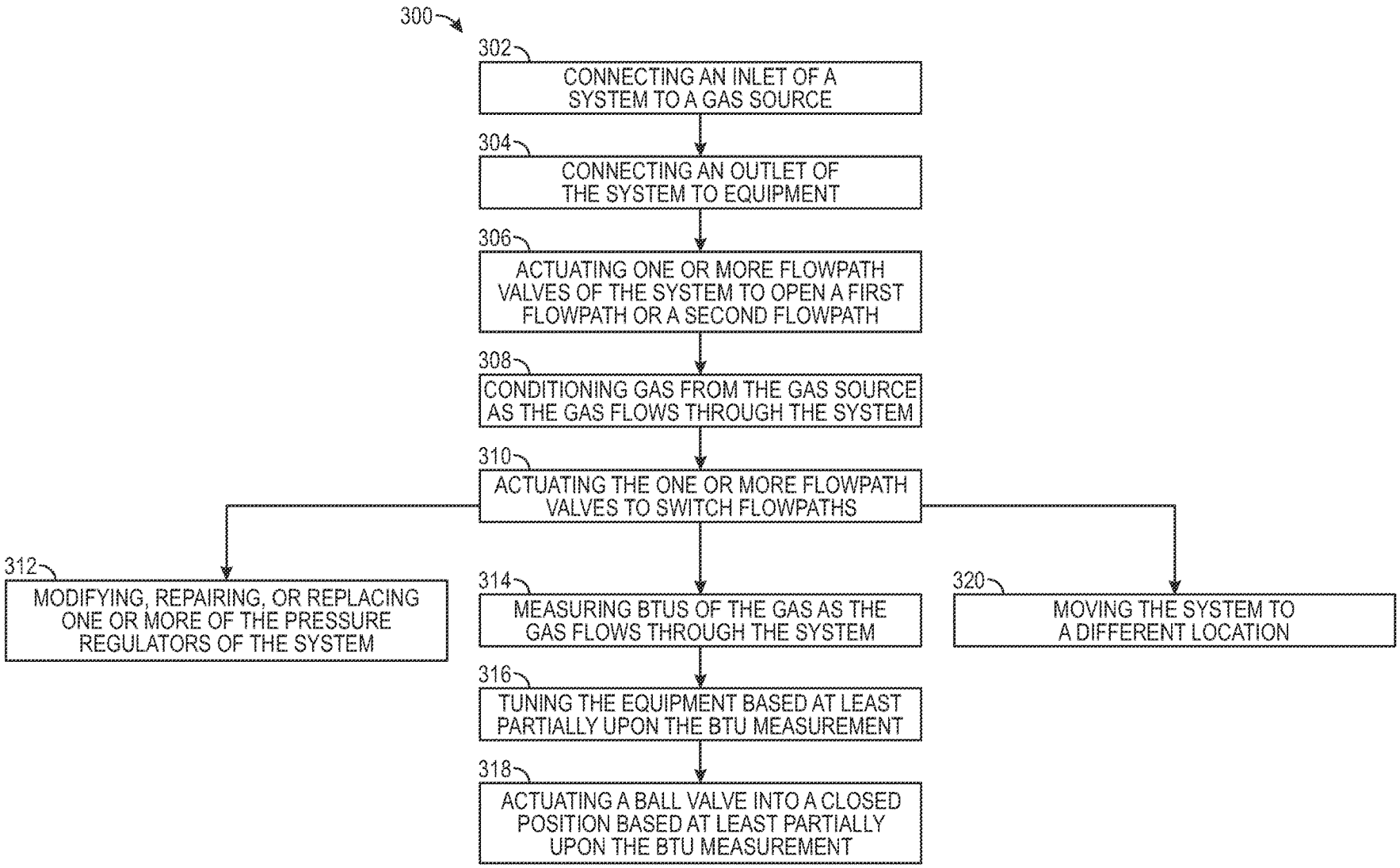
FIG. 3 illustrates a flowchart of a method for conditioning the gas, according to an embodiment.

FIG. 3 illustrates a flowchart of a method 300 for conditioning the gas, according to an embodiment. An illustrative order of the method 300 is provided below; however, one or more steps of the method 300 may be performed in a different order, combined, split into sub-steps, repeated, or omitted without departing from the scope of the disclosure.

The method 300 may include connecting the inlet 112 to the gas source 110, as at 302. The method 300 may also include connecting the outlet 150 to the equipment 160, as at 304.

The method 300 may also include actuating the one or more flowpath valves 140 to open the first flowpath 120 or the second flowpath 130 (or both), as at 306. As mentioned above, this actuation may be based at least partially upon the properties of the gas upstream from the system 110 (e.g., at the gas source 100) and/or the desired properties of the gas downstream from the system 110 (e.g., the operating ranges of the equipment 160).

The method 300 may also include conditioning the gas, as at 308. This may include starting the flow of the gas from the source 110 to the inlet 112. The gas may proceed to flow through the system 110, which may condition the gas. More particularly, the gas may flow through the designated flowpath 120, 130 (e.g., based upon the actuation of the flowpath valve(s) 140), where the gas may be regulated. The gas may flow out of the outlet 150 and to the equipment 160, which may use the gas as fuel.

The method 300 may also include actuating the one or more flowpath valves 140 to switch flowpaths 120, 130, as at 310. The valve(s) 140 may be actuated to switch flowpaths 120, 130 in response to (e.g., pressure) changes at the gas source 100 (e.g., pipeline). For example, the pressure at the gas source 100 (e.g., pipeline) may drop dramatically. In response, the system 110 may change the flowpath (e.g., switch from flowpath 130 to 120) to maintain adequate flow to the equipment 160 (e.g., engines). In one embodiment, the gas flow through the system 110 may be paused while the valve(s) 140 is/are actuated. In another embodiment, the gas may continue to flow through the system 110 while the valve(s) 140 is/are actuated.

The method 300 may also include modifying, repairing, or replacing one or more of the pressure regulators 122, 132, 134, as at 312. More particularly, this may include modifying, repairing, or replacing the pressure regulator 122, 132, 134 in the flowpath 120, 130 that does not currently have the gas flowing therethrough. As a result, the gas may continue to flow through one flowpath (e.g., flowpath 120) and be regulated therein while the modification, repair, or replacement takes place in the other flowpath (e.g., flowpath 130).

In an embodiment, the method 300 may also include measuring the BTUs of the gas, as at 314. As mentioned above, the BTU pipeline taps 148 measure the BTUs of the gas as the gas flows therethrough.

The method 300 may also include tuning the equipment 160 based at least partially upon the BTU measurement, as at 316. For example, the equipment 160 may be or include a frac engine. The engine may have different operating programs/settings that depend at least partially upon the gas quality. In an example, the engine may use a different program/setting to run gas in excess of 1100 BTU versus gas below 1100 BTU. The system 110 may automate the process and use the BTU information from the system 110 to automatically communicate that data to the engine and/or switch the program/setting to tune the engine.

The method 300 may also or instead include actuating the valve 114 into the closed position based at least partially upon the BTU measurement, as at 318. For example, the valve 114 may be closed in response to the BTU measurement being greater than an upper threshold for the equipment 160 (e.g., 1100 BTU or 1200 BTU, meaning that the gas may damage the equipment 160. As mentioned above, the valve 114 may also or instead be actuated into the closed position in response to the pressure of the gas downstream from the flowpaths 120, 130 being greater than a predetermined pressure threshold and/or the liquid level of the gas being greater than a predetermined liquid threshold.

The method 300 may also include moving the system 110 to a different location, as at 320. For example, the mobile unit 200 may move the system 110 to different equipment, a different wellbore, a different wellsite, or the like.

The terminology used herein is for the purpose of describing particular embodiments only and is not intended to be limiting. As used in the description and the appended claims, the singular forms "a," "an" and "the" are intended to include the plural forms as well, unless the context clearly indicates otherwise. It will also be understood that the term "and/or" as used herein refers to and encompasses any and possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

What is claimed is:

1. A system for conditioning a gas, the system comprising:

an inlet configured to receive the gas from a gas source;

a first flowpath downstream from the inlet, wherein the first flowpath comprises a first pressure regulator that is configured to regulate a pressure of the gas by a first amount;

a second flowpath downstream from the inlet, wherein the first and second flowpaths are parallel, and wherein the second flowpath comprises a second pressure regulator that is configured to regulate the pressure of the gas by a second amount that is different than the first amount;

one or more flowpath valves downstream from the inlet and upstream from the first pressure regulator, the second pressure regulator, or both, wherein the one or more flowpath valves are configured to actuate between a first position and a second position, wherein the one or more flowpath valves are configured to direct the gas to flow through the first flowpath and prevent the gas from flowing through the second flowpath while in the first position, and wherein the one or more flowpath valves are configured to direct the gas to flow through the second flowpath and prevent the gas from flowing through the first flowpath while in the second position; and an outlet downstream from the first and second flowpaths, wherein the outlet is configured to discharge the gas.

2. The system of claim 1, wherein the gas source comprises a pipeline, a wellbore, or a vehicle, wherein the gas comprises raw natural gas, compressed natural gas, liquid natural gas, or a combination thereof, and wherein the inlet is configured to receive the natural gas at any pressure ranging from about 100 psi to about 1440 psi.

3. The system of claim 1, wherein the first amount is between about 1 psi and about 100 psi, and wherein the second amount is between about 100 psi and about 1000 psi.

4. The system of claim 1, wherein the gas source comprises a pipeline, and wherein the one or more flowpath valves are configured to actuate in response to the pressure of the gas from the pipeline falling below a predetermined pressure threshold.

5. The system of claim 4, wherein the one or more flowpath valves are configured to actuate while the gas continues to flow through the system.

6. The system of claim 1, wherein the second flowpath also comprises a third pressure regulator that is upstream from the second pressure regulator, wherein the third pressure regulator is configured to monitor the pressure of the gas downstream from the second pressure regulator and to regulate the pressure of the gas by a third amount in response to the monitored pressure being greater than a predetermined pressure threshold, wherein the third amount is different from the first amount and the second amount.

7. The system of claim 1, further comprising an actuated ball valve positioned upstream from the first and second flowpaths, wherein the actuated ball valve is configured to automatically actuate into a closed position to prevent the gas from flowing therethrough in response to the pressure of the gas, downstream from the first pressure regulator, the second pressure regulator, or both, being greater than a predetermined pressure threshold.

8. The system of claim 7, further comprising a British thermal unit (BTU) measurement pipeline tap positioned downstream from the first and second flowpaths, wherein the BTU measurement pipeline tap is configured to measure the BTUs of the gas, and wherein the actuated ball valve is configured to actuate into the closed position in response to the measured BTUs being greater than or less than a predetermined BTU threshold.

9. The system of claim 1, wherein the one or more flowpath valves are configured to actuate between the first position, the second position, and a third position, and wherein the one or more flowpath valves are configured to direct a first portion of the gas to flow through the first flowpath and a second portion of the gas to simultaneously flow through the second flowpath while in the third position.

10. The system of claim 1, wherein the system does not comprise an overprotection relief valve that is configured to vent the gas to the atmosphere.

11. A system for conditioning a natural gas, the system comprising:

an inlet configured to receive the natural gas from a gas source;

a strainer downstream from the inlet, wherein the strainer is configured to remove debris from the natural gas;

a first flowpath downstream from the strainer, wherein the first flowpath comprises a first pressure regulator that is configured to regulate a pressure of the natural gas by a first amount that is between about 1 psi and about 100 psi;

a second flowpath downstream from the strainer, wherein the first and second flowpaths are parallel, wherein the second flowpath comprises a second pressure regulator and a third pressure regulator, and wherein the second pressure regulator is configured to regulate the pressure of the natural gas by a second amount that is between about 100 psi and about 1000 psi;

one or more flowpath valves downstream from the strainer and upstream from the first pressure regulator, the second pressure regulator, the third pressure regulator, or a combination thereof, wherein the one or more flowpath valves are configured to actuate between a first position and a second position, wherein the one or more flowpath valves are configured to direct the natural gas to flow through the first flowpath and prevent the natural gas from flowing through the second flowpath while in the first position, and wherein the one or more flowpath valves are configured to direct the natural gas to flow through the second flowpath and prevent the natural gas from flowing through the first flowpath while in the second position; and an outlet downstream from the first and second flowpaths, wherein the outlet is configured to discharge the natural gas.

12. The system of claim 11, wherein the third pressure regulator is upstream from the second pressure regulator, wherein the third pressure regulator comprises a monitor pressure regulator that is configured to monitor the pressure of the natural gas downstream from the second pressure regulator and to regulate the pressure of the natural gas in response to the monitored pressure being greater than a predetermined pressure threshold.

13. The system of claim 12, further comprising a ball valve positioned between the inlet and the one or more flowpath valves, wherein the ball valve is configured to automatically actuate into a closed position to prevent the natural gas from flowing therethrough in response to the pressure of the natural gas, downstream from the first and second flowpaths being greater than the predetermined pressure threshold.

14. The system of claim 11, further comprising:

a ball valve positioned between the inlet and the one or more flowpath valves; and a British thermal unit (BTU) measurement pipeline tap positioned downstream from the first and second flowpaths, wherein the BTU measurement pipeline tap is configured to measure the BTUs of the natural gas, wherein the ball valve is configured to automatically actuate into a closed state to prevent the natural gas from flowing therethrough in response to the measured BTUs being greater than or less than a BTU threshold.

15. The system of claim 11, further comprising:

a ball valve positioned between the inlet and the one or more flowpath valves; and a gas scrubber positioned downstream from the first and second flowpaths, wherein the gas scrubber is configured to remove liquid from the natural gas, wherein the ball valve is configured to automatically actuate into a closed state to prevent the natural gas from flowing therethrough in response to a liquid level in the scrubber being greater than a liquid threshold.

16. A method for conditioning a gas, the method comprising:

connecting an inlet of a system to a gas source;

connecting an outlet of the system to equipment;

actuating one or more flowpath valves of the system into a first position to direct gas from the gas source to flow through a first flowpath of the system and not a second flowpath of the system, wherein the first and second flowpaths are parallel, wherein the first flowpath comprises a first pressure regulator that is configured to regulate a pressure of the gas by a first amount, and wherein the second flowpath comprises a second pressure regulator that is configured to regulate the pressure of the gas by a second amount that is different than the first amount; and conditioning the gas with the system, wherein conditioning the gas comprises:

receiving the gas from the gas source;

removing debris from the gas;

regulating the pressure of the gas; and discharging the gas to the equipment which uses the gas as a fuel.

17. The method of claim 16, further comprising actuating the one or more flowpath valves of the system into a second position to direct the gas from the gas source to flow through the second flowpath and not the first flowpath in response to the pressure of the gas at the source changing.

18. The method of claim 16, further comprising modifying, repairing, or replacing the second pressure regulator while the one or more flowpath valves are in the first position and the gas is flowing through the first flowpath.

19. The method of claim 16, further comprising:

measuring British thermal units (BTUs) of the gas downstream from the first and second flowpaths; and tuning the equipment based at least partially upon the measured BTUs, wherein the equipment comprises a hydraulic fracturing engine.

20. The method of claim 16, further comprising:

measuring British thermal units (BTUs) of the gas downstream from the first and second flowpaths; and actuating a ball valve into a closed position in response to the measured BTUs being greater than or less than a predetermined BTU threshold, wherein the ball valve is positioned downstream from the inlet and upstream from the one or more flowpath valves.

* * * * *